US005242025A

United States Patent [19]

Neill et al.

[11] Patent Number: 5,242,025

[45] Date of Patent: Sep. 7, 1993

[54] GUIDED OSCILLATORY WELL PATH DRILLING BY SEISMIC IMAGING

[75] Inventors: William M. Neill, Anaheim; Fred Aminzadeh, Anaheim Hills; A. M. Sam Sarem, Yorba Linda; Julio M. Quintana, Bakersfield, all of Calif.

[73] Assignee: Union Oil Company of California, Los Angeles, Calif.

[21] Appl. No.: 906,754

[22] Filed: Jun. 30, 1992

[51] Int. Cl.[5] ..... E21B 7/00

[52] U.S. Cl. ..... 175/26; 175/50

[58] Field of Search ..... 175/26, 48, 57, 50, 175/61, 62; 166/308, 381

[56] References Cited

U.S. PATENT DOCUMENTS

| | | | |
|---|---|---|---|
| 3,224,513 | 12/1965 | Weeden, Jr. | 175/26 |
| 4,578,675 | 3/1986 | MacLeod | 175/50 X |
| 4,986,361 | 1/1991 | Mueller et al. | 166/381 |
| 5,005,649 | 4/1991 | Smith et al. | 166/308 |
| 5,038,108 | 8/1991 | Lessi et al. | 175/50 X |
| 5,064,006 | 11/1991 | Waters et al. | 175/50 X |
| 5,079,749 | 1/1992 | Aminzadeh et al. | 367/73 |
| 5,117,915 | 6/1992 | Mueller et al. | 166/381 |

OTHER PUBLICATIONS

"Horizontal Well Completions in Alaska", World Oil., Mar. 1990, pp. 37–44, by T. O. Stagg and R. H. Reiley.

"Vertical Seismic Profiling: Technique Applications, and Case Histories", by A. H. Balch and Myung W. Lee, pp. 1–67.

*Primary Examiner*—Thuy M. Bui

*Attorney, Agent, or Firm*—Gregory F. Wirzbicki; William O. Jacobson

[57] ABSTRACT

Real-time monitoring of a target production zone is followed by an oscillatory drilling path to create a borehole having improved zone drainage capability. Real-time monitoring uses geophones placed in adjacent wells or the well being drilled. The drilling process itself generates the seismic signals. When the geophones are located in the well being drilled, the seismic signals are transmitted from downhole to surface through intermittent pressurization of drilling mud. Once drilling penetrates the zone, the oscillatory path is followed by fracturing to improve fluid drainage paths and minimize additional drilling.

31 Claims, 3 Drawing Sheets

GUIDED OSCILLATORY WELL PATH DRILLING BY SEISMIC IMAGING

FIELD OF THE INVENTION

The invention relates to underground well drilling devices and processes. More specifically, the invention is concerned with providing a method for drilling an extended reach well in a stratified oil reservoir having limited permeability.

BACKGROUND OF THE INVENTION

Many oil-producing layers are found in stratified formations. For example, a mostly horizontal layer in an oil-bearing sedimentary formation may be bounded on the top and bottom by low permeability, non-oil producing, shale layers. Traditional vertical wells may produce oil from only a small portion of a stratified formation, draining a thin radial zone in oil-producing layers around the well.

The technology to drill and complete extended reach wells can increase the recovery of fluids from these stratified formations when compared to vertical wells. Extended reach wells, such as wells drilled out from offshore platforms or onshore "islands," are drilled and completed at an inclined angle to the vertical to follow the trend of the layer. The angle can be set so that a portion of the extended reach well is within a thin, nearly horizontal layer, or for a thicker layer, a less-than-horizontal incline path can slowly traverse or angle across the thicker layer. The nearly horizontal or angled portion is typically located below an initial (top), more-vertical portion drilled to reach the oil-producing layer.

Long, nearly horizontal or slanted wells can be more costly than a vertical well, but these extended reach wells may also be more productive for low permeability (i.e., "tight") reservoirs. The production is increased because of the greater surface area of the producing zone exposed to the wellbore, i.e., draining a larger portion of a tight productive layer.

However, problems maintaining the borehole portion drilled within a long thin layer, which can be composed of several producing sublayers, have been experienced. Even with current seismic survey data and imaging (accomplished prior to drilling), the extent, depth, and thickness of a thin oil-bearing layer is not always well known, especially over long distances. Even if the boundaries of the target layer are fairly well known, controlling the location of the borehole to follow a thin layer can present problems, especially when the face being drilled is several kilometers from the surface drilling location and the layer's thickness is measured in meters. In addition, the increased production from an extended reach well may not justify the increased cost of the extended reach well. Thus, achieving the goal of economic production from a new target zone, especially a small target zone, has not always been achieved.

SUMMARY OF THE INVENTION

Such problems are avoided in the present invention by real-time imaging of the target zone during drilling to detect optimal drilling direction and oscillating the borehole path after the target is reached. The measurement while drilling (MWD) produces a real-time image that reduces the risk of missing the target. Once the target is penetrated, an oscillating path improves the draining of the target zone. Fracturing of several locations along the oscillatory path may further improve the draining of the target.

Real-time imaging is derived from data provided by seismic geophones placed in adjacent wells and using the drilling process itself to generate the seismic signals. The multiple geophones allow triangulation to determine the location (image) of the boundary of the target. The image of the target is used to guide the drilling direction towards the target zone. The more accurate image also allows the drilling path to oscillate up and down well within and through the target zone once it is penetrated.

The oscillating well path is expected to improve production from large target formations as well as thin target layers. This is especially true for anisotropic formations which have greater horizontal than vertical permeability—a common occurrence. The multiple and periodic penetrations of many horizontal planes by the oscillatory path assure drainage of many portions of the target zone.

The real-time seismic data are used to iteratively define the (image of the) boundaries of a target zone or formation, especially those not already penetrated by an existing wellbore. The drilling itself generates seismic vibrations within one underground formation and sensed by receivers in nearby underground locations. The iterations in imaging and proximity of the seismic source and receivers to the target produce progressively more accurate data which are used to produce progressively more accurate boundary images. When seismic generation and sensing is within the same formation, the analysis can produce a very accurate determination (or image) of the boundaries of the target zone. This iteration and accuracy will reduce the risk of missing the target zone and allow accurate oscillation within the zone during drilling. This method reduces the drilling time and costs and improves the productivity of the drilled well.

BRIEF DESCRIPTION OF THE DRAWINGS

In these Figures, it is to be understood that like reference numerals refer to like elements or features.

DETAILED DESCRIPTION OF THE INVENTION

Figure 1:
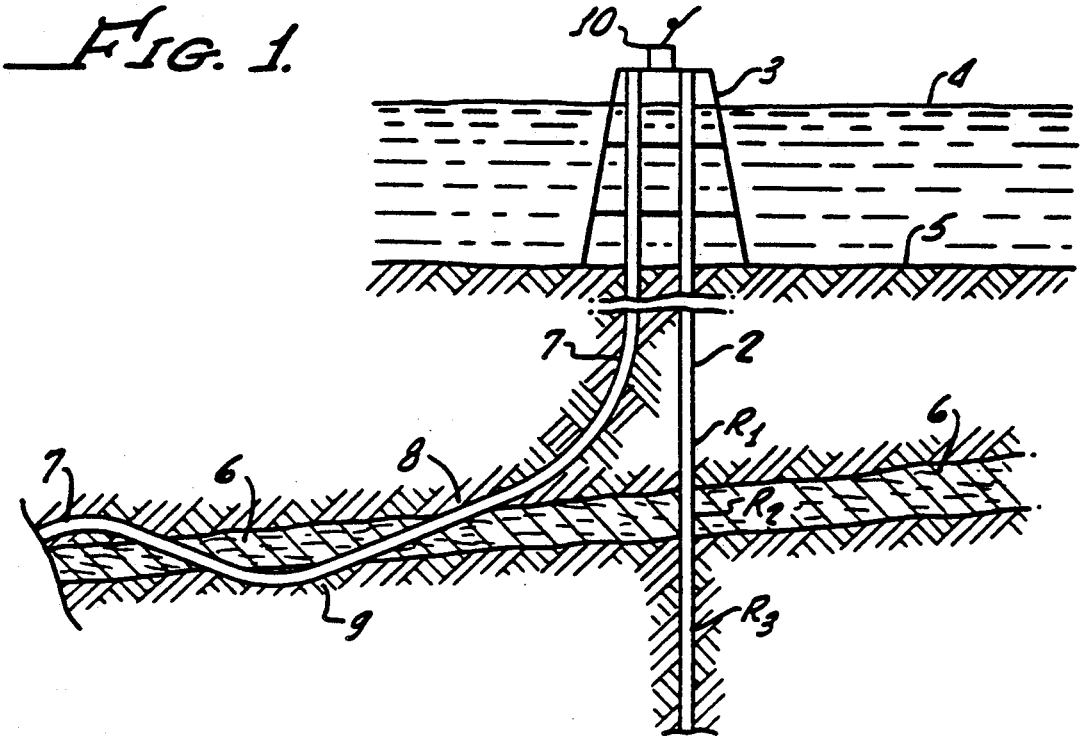
FIG. 1 shows an underground schematic of geophone array in an existing well and an extended reach well being drilled into a thin target layer.

FIG. 1 shows schematic view of an existing offshore well or wellbore 2 extending underground from an offshore platform or site 3. Wellhead (and other process) equipment is normally located on the platform 3 and attached to the existing well 2, but is not shown for clarity. Although the existing well 2 is shown extending below sea level 4 and below sea floor (or ground surface 5), an existing vertical or extended reach well located on shore may also be used for locating the geophone array. An array of geophones or receivers $R_1$ through $R_3$ is placed at intervals in the wellbore 2. The location of the array is proximate to a target layer or zone 6 which is to be produced through a new well or wellbore 7 being drilled.

The geophones $R_1$ through $R_3$ are capable of detecting the vibrations or seismic waves generated by the drilling of new well 7 and generating an electrical signal related to the detected vibrations. As shown, geophone $R_2$ is located within the target layer 6. Because formation differences affect the transmissivity of seismic waves, the signals from the in-layer geophone $R_2$ should clearly change when the target layer 6 is penetrated by the borehole 7 (at boundary penetration point 8) and when the borehole exits target layer 6 (at boundary penetration point 9). The two other geophones $R_1$ and $R_2$ are located outside target layer 6, and they will more clearly detect the drilling of new well 7 as it approaches and exits from target zone 6. The out-of-zone geophones $R_1$ and $R_3$ can also be used to triangulate the location of the seismic (drilling) source of vibrations.

Geophones $R_1$ through $R_3$ produce electrical or other signals (or measurements) related to drill bit vibrations cutting into the target layer 6 while drilling. The measurement while drilling (MWD) signals are transmitted to an imager-controller 10 which uses the MWD signals to calculate an "image" of the target zone boundaries. The imager-controller 10 then controls the direction of drilling the new well 7 based upon the image. Data from the existing well 2 (and perhaps other sources of information) has identified the initial image of the boundaries of the target layer 6 (i.e., estimated the depth, areal extent, and thickness of the target layer), but the initial image may not be accurate. As the drilling progresses, geophone MWD data can be used by the imager-controller 10 to revise these estimates and redirect the drilling direction to more quickly and accurately intercept the target layer 6.

Although the maximum number of receivers is theoretically unlimited, practical limitations generally limit the number in any one well or surface location to a range from one to about 100, preferably within a range of from about 2 to 40. Although many different and conventional receivers can be used at many different locations (including surface locations), the preferred receiver is clamped or otherwise attached at locations within a wellbore and is capable of detecting seismic signals transmitted through drilling muds (during drilling of the well in which the receiver is located) as well as through surrounding formations.

Although the location and spacing shown (one in-zone receiver bracketed by two others outside the zone) is not atypical, other spacings and locations are possible. Spacing between geophones can range from about 1 foot (0.3048 meter) to thousands of feet (or meters), but more typically with range from about 10 to 100 feet (3.048 to 30.48 meters). Underground locations of geophones that can detect drilling can range up to thousands of feet (or meters) from the boundary of the target zone. Although the drilling source location is moving at a drilling speed through the formation, the speed and location (at any one time) with respect to the geophones can vary widely. Typically however, the moving drilling source and geophones are below a depth of about 100 feet (30.48 meters) when the geophones are collecting data, more commonly at depths of at least about 1,000 feet (304.8 meters). The distance between the geophones and the drilling source is theoretically nearly unlimited, but is more commonly no more than about two miles (3.2 kilometers).

Once the target zone or layer 6 is penetrated, the imager-controller produces an oscillatory or wavering well path within the target layer 6. The oscillatory path improves the production of fluids from (or injection of fluids to) the target layer 6. Although the path can be the oscillatory V-shaped path shown, the path may also define an oscillating W-shape (e.g., oscillating within then outside the top of the target layer 6) or a flattened N-shape pattern (e.g., unequal legs or a stair stepping pattern through a target layer). Another possible oscillatory path in a relatively thin layer can be more sinusoidal. Irregular or meandering paths are also possible, especially for target production zones that are not thin layers.

Although a relatively thin layer 6 is shown in FIG. 1, an oscillatory path within a much thicker target layer can also provide substantial fluid production benefits. This is especially true when the target layer is composed of smaller sublayers or is otherwise anisotropic. The oscillatory pattern intercepts many sublayers two or more times at widely separated locations. The widely separated intercept locations (e.g., in a planar sublayer) tend to drain many sublayers at many locations, not just draining many sublayers at a single location (when compared to a vertical well or a slanted completion through the layer) or not just draining a few sublayers at many locations (when compared to an extended reach well following near the middle of a layer).

The oscillatory path may be even more beneficial in a "tight" target zone 6 where fracturing is needed. The fractures produced, e.g., by hydraulic fracturing methods, may not be equal in length or direction. The unequal lengths produced are described by a fracture half-length distance. By multiple (oscillatory) penetrations at locations separated by distances larger than the fracture half-length, production effectiveness of fracturing is enhanced.

The production effectiveness of oscillatory well paths are further described by the following example which is illustrative of a specific mode of practicing the invention and is not intended as limiting the scope of the invention as defined by the appended claims. The example is from a simulation study of a Santa Clara oil field located in California. The target layer in this field is a thick, nearly horizontal formation. The upper portion of this oil-bearing layer is the most productive.

EXAMPLE 1

Three well path configurations were compared, 1) a vertical well path through the target layer, 2) a substantially straight, but deviated well path (at 75 degrees) angling through the target layer, and 3) an oscillatory V-shaped path through the target layer with slanted segments of 75 and 105 degrees from the vertical, intercepting the top portion or boundary of the target layer about every 2,000 feet (610 meters). The V-shaped completion path (1) is about twice as long as the deviated path configuration (2), but production simulations predict a 92 percent productivity increase without fracturing.

A still further increase in productivity is expected by hydraulic fracturing, especially of the V-shaped path (1). A fracture half-length of about 200 feet (60.96 meters) around any one the paths is expected to be produced by conventional hydraulic fracturing methods. Although limited pressure interference of the oscillatory path (3) is expected at this fracture half-length, especially between the top 2000 foot (609.6 meter) interceptions, the further increase in productivity of the oscillatory path (3) compared to the deviated path (2) is expected to, again, be on the order of double.

These very substantial productivity increases for the sample oscillatory V-path (3) can be further compared to only a 10 percent increase by the slanted well path well (2) over the vertical path (1) even though the total length (and cost) of the well increased substantially. Hydraulic fracturing of slanted well path (2) is expected to improve productivity of the vertical path (1) by on the order of doubling, but the risk of water intrusion is significantly increased.

In addition to horizontal layer targets (as discussed in Example 1), productivity increases in other target zones over a substantially straight or single deviation direction path are expected to be substantial, especially when permeability is low. The oscillatory path method is expected to be useful in formations having permeabilities ranging from about 1 to 200 millidarcies (md), and be especially useful for formations having permeabilities ranging from about 5 to 40 md. Productivity increases of oscillatory paths in these low permeability formations over prior art wellbore paths are expected to range from as little as 10 to as much as 200 percent, but are more commonly expected to range from about 50 to 100 percent.

In still other formations and fields, the full V-shaped path may not be desirable, especially for water-bearing shoulder layers around a thin target layer 6. Multiple penetrations (or hydraulic fracturing near the water-bearing zones) would cause, or at least risk, increased water breakthrough into the produced fluids. An example of a formation where fracturing would not generally be recommended is the Hemlock formation in Alaska's Cook Inlet field.

Figure 2:
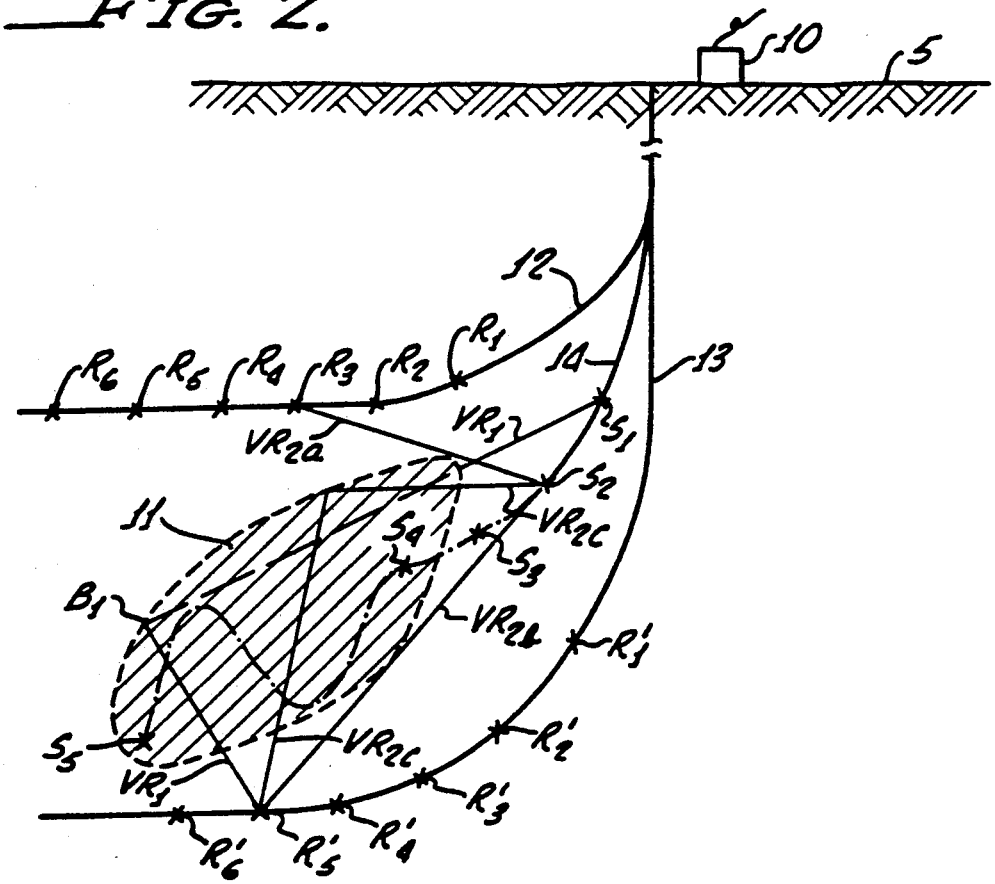
FIG. 2 shows an underground line schematic of geophone arrays in two existing wells and an infill well being drilled towards a trap target zone.

FIG. 2 shows an underground line schematic view of infill drilling towards a previously unproduced, "oil-trap" target zone 11. The boundaries of trap 11 are shown as dashed lines since the exact location of these boundaries is not well defined and the location shown is only an initial estimate.

Two existing extended reach wells, 12 and 13, have not penetrated the target trap 11, but have portions that are proximate to the trap 11. Trap 11 does not extend horizontally as the sedimentary layer(s) shown in FIG. 1, but is a pocket such as a geological fold or trap. Although existing (on-shore) extended reach wells 12 and 13 are shown in FIG. 2, infilling to trap 11 between vertical or slanted wells off- or on-shore is also possible.

Although receivers may be placed in many different locations, FIG. 2 shows each existing well instrumented with geophone or receiver arrays $R_1$ through $R_6$ or $R'_1$ through $R'_6$. The receivers, similar to the receivers shown in FIG. 1, are capable of detecting vibrations from drilling and producing an electrical signal related to the detected vibrations. The electrical outputs of the receivers are electrically connected to imager-controller 10.

An alternative location for at least one receiver $R_0$ is near the surface location of wellbore 14 being drilled. The vibrations or seismic signals produced downhole by the drilling may be transmitted to the surface receiver $R_0$ through intermittent pressurization of drilling muds (or other fluids) in wellbore 14 being drilled. This is similar to the transmission of separate seismic instrument signals from bottom to surface through the use of measurement while drilling (MWD) instrumentation and techniques.

The new well path 14 being drilled is shown extending from surface 5 to source location $S_2$. The direction of the dashed line extending below location $S_2$ shows a controlled change in the direction of drilling towards the trap 11. The changed direction is based upon the data generated from the geophone arrays during drilling, e.g., when the drilling face was traversing from source location $S_1$ to $S_2$, and used to revise (the image of) the location of the boundary of the target zone 11.

Conventional rotary drilling bits and rotary speeds can be used to drill-generate the source vibrations. Conventional offset drilling techniques can generate the oscillatory paths required. Although the maximum rotary speed is theoretically unlimited, rotary speeds are more typically expected to range from nearly zero to about 150 rpm. Drilling speed is also theoretically unlimited, but is expected to range from nearly zero (or a fraction of 1) to about 90 feet per hour (a fraction of 0.3048 to about 27.43 meters/hour). Other drilling techniques, such as jet drilling, can also provide sufficient source vibrations and controllable directional drilling.

The drilling (source) vibrations emanate in all directions, but the vibrations can be represented by vibration rays, VR, radially emanating from a source location. For example, one vibration ray $VR_1$ is shown on FIG. 2 emanating from a first source location $S_1$ and being reflected at a boundary location $B_1$ of the target trap 11 towards receiver or geophone $R'_5$. Knowledge of the time for the vibration ray $VR_1$ to reach the geophone $R'_5$ and the location of the source $S_1$ and geophone $R'_5$ can be used to determine the location and angle of the boundary point $B_1$.

Three vibration rays, $VR_{2a}$ through $VR_{2c}$, are shown emanating from a second source location $S_2$. The first of these vibration rays $VR_{2a}$ is directed towards and is detected (without reflection at a boundary) by geophone $R_3$. The second of these vibration rays $VR_{2b}$ is directed towards and is directly detected by geophone $R'_5$. By measuring the time between the receipt of these direct rays and triangulation, a more precise location of the second source location $S_2$ can be established. The third of these vibration rays $VR_{2c}$ is reflected at boundary point $B_2$ towards geophone $R'_5$. Using the time differences and established locations of the source and receivers, the boundary point $B_2$ location and angle can be determined and imaged.

The overall boundary location, based upon geophone data during drilling, may not be the same as the initial estimates of the boundary location of trap 11. The revised location of the boundary of trap 11 can require changing the direction of the new well in order to penetrate the trap 11 at the desired boundary point. The changed direction is shown by the dashed-dotted path of new well 14 passing through the third source location $S_3$. If even greater accuracy in determining the image (shown in two dimensions) of the three-dimensional boundary is needed, a non-continuous seismic or vibration source can be placed at the drilling face or at one of the geophone locations. A baseline receiver can also be placed at the changing drilling source location (e.g., $S_1$ through $S_3$) to improve accuracy.

When the new wellbore 14 drilling face (and seismic source) penetrates the trap 11, as shown at the fourth source location $S_4$, even more accurate seismic locating of the boundaries of the target trap 11 is possible. The improved accuracy results from the continuous "shooting" of the seismic source during drilling because the drilling is located at different locations, including final drilling (vibration source) locations within the target. These factors substantially improve the quality of the calculated seismic "image" of the boundary, allowing simplified stacking and data migration (imaging) calculations.

The seismic data can also improve the understanding of the lithology of the target and nearby geological structures. The velocity of the seismic signals will change with the presence of trapped oil or gas, and velocity data passing through the formation can be used to detect other oil-bearing traps or improve the definition of what is trapped in the original target zone.

The direction of drilling changes again after drilling reaches source location $S_4$, as shown by the dash-dotted oscillatory path between $S_4$ and $S_5$. However, the dash-dotted path shown in FIG. 2 does not penetrate the boundaries of the trap zone 11 (as did the oscillatory path shown in FIG. 1), but only approaches these boundaries. This minimizes the risk of water breakthrough from adjacent formations, while maximizing oil production from the trap zone 11, especially if the formation permeability is low and/or fracturing is required.

This inside-the-boundary oscillatory path can also be equivalent to the penetrating-the-boundary oscillatory path if a pseudo, inward-shifted boundary is defined, i.e., the well path penetrates a false boundary and is turned prior to penetrating the actual boundary of the target zone. The amount of the pseudo-boundary inward shift can be fixed or made a function of the calculated image shape and/or the breakthrough risk one is willing to accept.

The oscillatory path may a simple, boundary-reflected straight-line shape, but the controller 10 may also calculate a more complex optimum oscillatory path. The optimum path may be based upon seismic data as well as existing well test data, e.g., a W-shaped path to intercept lower portions of the target zone more frequently. If the risk of water breakthrough is greater at one portion of the boundary than at other portions, the oscillatory path can be controlled away from the high risk portion of the boundary.

Figure 3:
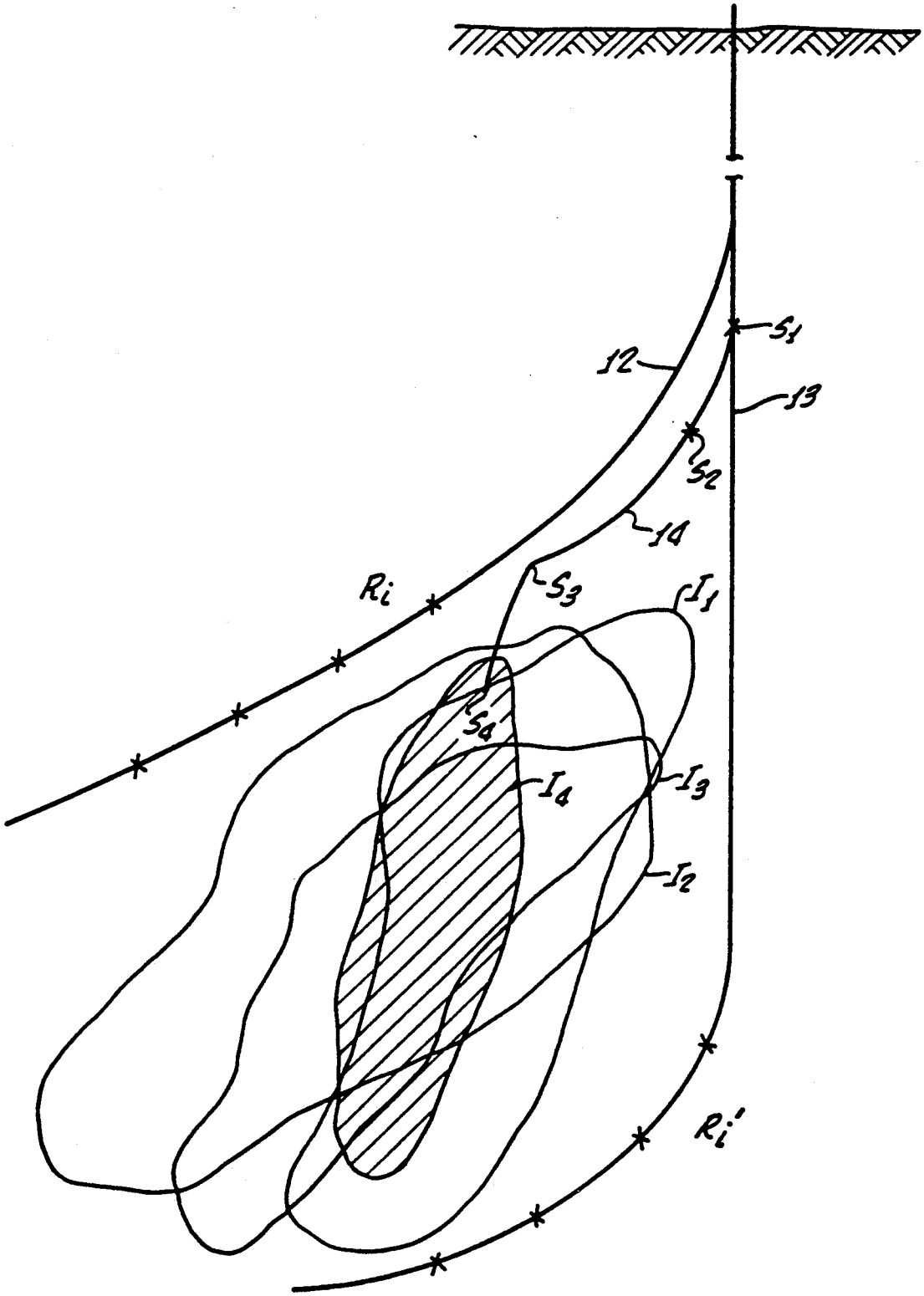
FIG. 3 shows an underground line schematic of the changing image of the trap target zone shown in FIG. 2.

FIG. 3 shows a schematic representation of the changing "image" of the boundaries of target trap 11 during drilling. The first boundary image $I_1$ is derived from prior seismic data and/or geophone data when the drilling is cutting into the underground material at source location $S_1$. As the source location gets closer to the trap boundary, the image changes to $I_2$ (when drilling is at source location $S_2$), to $I_3$ (when drilling is at source location $S_3$), and finally to $I_4$ when drilling is at source location $S_4$ inside the trap 11. Although further changes to the "image" of the boundary is possible once the drilling source is within the trap 11, the changes to the "image" are likely to be small.

As the "image" changes during drilling towards the target trap 11, the well path is controlled to maximize fluid production and minimize costs. This may be a minimum length path (if total drilling costs/unit length are high) or a path to avoid costly obstacles or high risk faults. The likelihood of intersecting the wellbore with the increasing accurate image of the boundaries is improved and the production risks (e.g., long path, high frictional losses) minimized. Once inside the boundaries, the oscillatory path maximizes fluid production from the target zone. If the "image" of the boundary does not change or geophone data is no longer needed once the path is near of inside the target, data collection and imaging can be terminated to save additional costs.

Figure 4:
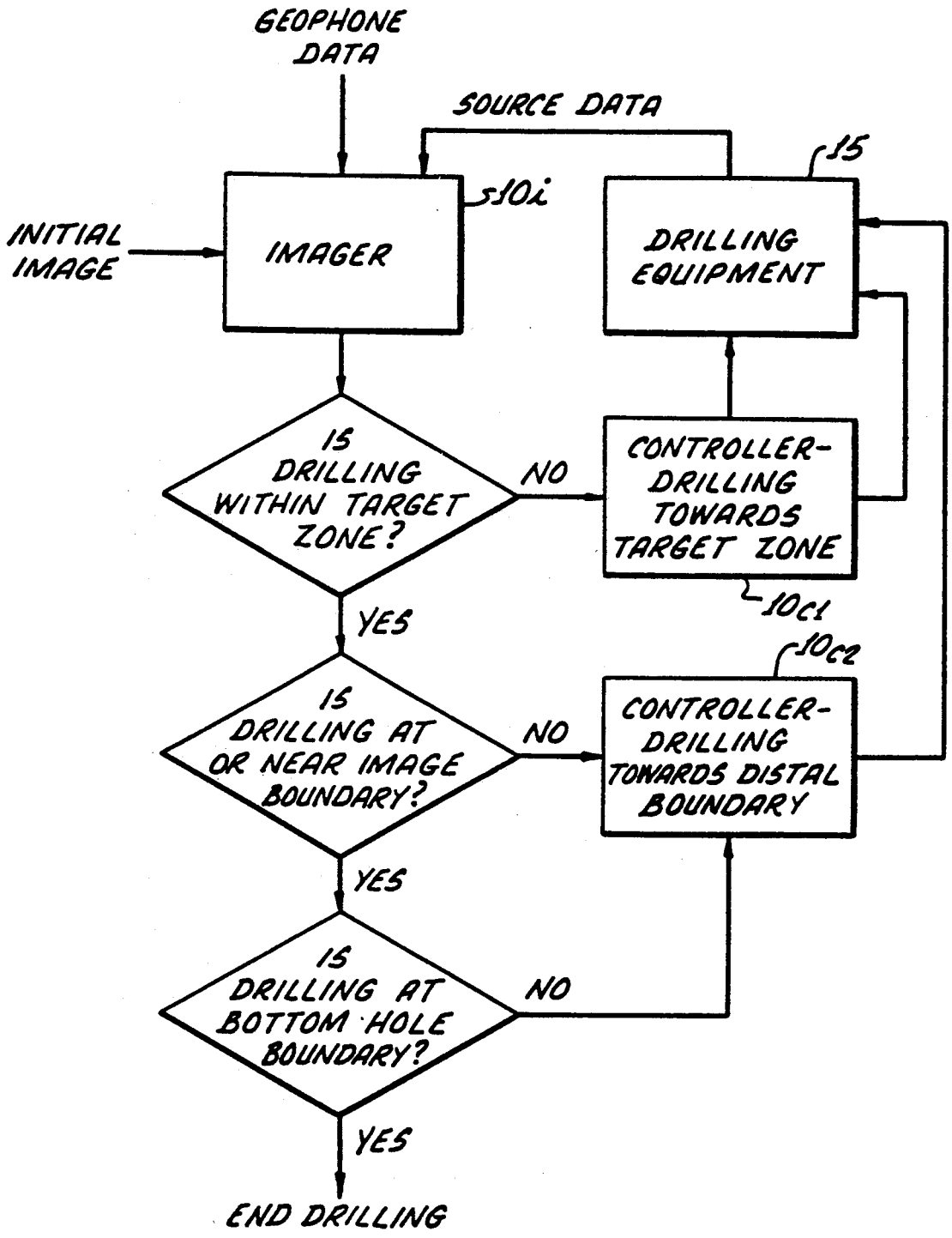
FIG. 4 shows a block diagram of the drilling process.

The process of using the device is shown in FIG. 4. An imager of seismic signals, such as a data processor, can be combined with a drilling controller, such as a digital processor into a single device, as shown as item 10 in FIGS. 1 and 2, but as shown in FIG. 4, the imager $\mathbf{10}_i$ and controller(s) $\mathbf{10}_{c1}$ and $\mathbf{1O}_{c2}$ may also be separate devices. These devices may be automatically or manually operated. The controllers $\mathbf{10}_{c1}$ and $\mathbf{10}_{c2}$ are two separate devices, one for controlling during the drilling approach to the target and a second for controlling during the oscillatory drilling after the target is penetrated.

The imager $\mathbf{10}_i$ is supplied with geophone data, including the (normally fixed) locations of the geophones within the existing well(s). An initial estimate of the boundary can be provided to the imager $\mathbf{10}_i$ as well as source data (e.g., drill bit rotational start/stop times and depth of the cutting face). If the drilling face has not yet reached a location within the boundary of the target zone, controller $\mathbf{10}_{c1}$ directs the drilling equipment 15 to drill towards the target zone. This direction may be towards the middle of the imaged boundary or towards the nearest portion of the target's imaged boundary.

If the drilling face is at or near the image boundary, controller $\mathbf{10}_{c2}$ begins oscillatory drilling, redirecting the drilling towards a distal portion of the boundary. The oscillations may have components in both the horizontal and vertical planes, but oscillations predominantly in the vertical plane are generally expected to produce better results in stratified formations. The drill path dan be controlled to remain within a set (or variable) distance of the boundary. The range of controlled distances is theoretically unlimited, but if water-breakthrough is a concern, the boundary is typically not approached closer than 5 feet (1.524 meters). Once the oscillatory drilling reaches the bottom or the end of the target zone, drilling equipment 15 is stopped by controller $\mathbf{10}_{c2}$.

The drilling equipment 15 can be conventional rotary drilling equipment or may include flotation devices as described in U.S. Pat. No. 4,986,361 and U.S. Pat. No. 5,117,915 which are incorporated in their entireties herein by reference. Oscillatory path drilling can be assisted by including an offset in the drill string. Other conventional directional drilling equipment may also be used.

Fracturing of the oscillatory path may be accomplished by conventional methods, such as hydraulic fracturing. Fracturing may also be accomplished by a multiple fracture production method using rupture discs as described in U.S. Pat. No. 5,005,649 which is incorporated in its entirety herein by reference. When the oscillatory well path is near a high risk boundary, the rupture discs of the multiple fracture production technique may also be oriented to preferentially fracture away from the boundary to minimize the breakthrough risk at the boundaries. Other techniques to minimize the breakthrough risk may also be used.

Fracturing may be accomplished after or prior to completing the oscillatory path drilling. If fracturing is accomplished prior to completion, the geophone array can be used to provide an image of the fractures produced, the remainder of the oscillatory path drilling can be directed towards portions of the target zone where fractures have not penetrated. This minimizes the need to drill through some (fully fractured) portions of the target zone without sacrificing the productivity of the well.

The image analysis of seismic data from drilling-source geophone arrays (producing the images) can be comparable to conventional analysis of data from seismic shots detected by surface arrays or vertical arrays in existing wells. Although the drilling is somewhat continuous, drilling changes (such as rotary speed and bits) can also provide discontinuous signals, similar to seismic shots. The analysis method may also use the ray tracing method as described in U.S. Pat. No. 5,079,749 which is incorporated in its entirety herein by reference. Geophones located at the surface may also replace or supplement the arrays in the existing wells.

The invention satisfies the need to substantially improve underground well fluid production or injection, especially from small zones targeted during infill drilling. The well path to the targeted producing (or injection) zone can be more direct, the direction of drilling being corrected by real time data. Once the zone is penetrated, fracturing and a zig-zag or oscillatory path maximizes conduit surface area drainage of producing formations.

Although the deviation angle (from the vertical) of each leg of the oscillatory path in a horizontal layer is theoretically unlimited, the angles are typically limited to a range of from 45 to 135 degrees from vertical (up to 45 degrees from the horizontal), preferably within the range from 60 to 120 degrees from vertical, most preferably within the range from 75 to 105 degrees from vertical. The oscillatory path may also traverse a zone in one plane and reflect back across the zone in another plane.

Although the maximum number of oscillatory cycles are theoretically unlimited, the number is typically limited to an overall range of from about ½ to 4 cycles, preferably within the range from at least about one to 2 cycles.

Still other alternative embodiments are possible. These include: extending the oscillatory well path from one target zone to a second zone of interest; new drilling to extend an existing wellbore so that the source and geophone locations are located within the same wellbore; using the geophone arrays to image the hydraulic fracturing; and drilling a new wellbore to a first depth, installing at least one geophone within the initial portion of the wellbore, and using the geophone data to guide and/or oscillate the path of the remainder of the wellbore.

While the preferred embodiment of the invention has been shown and described, and some alternative embodiments also shown and/or described, changes and modifications may be made thereto without departing from the invention. Accordingly, it is intended to embrace within the invention all such changes, modifications and alternative embodiments as fall within the spirit and scope of the appended claims.

What is claimed:

1. A method of drilling a wellbore into the boundary of an underground target zone having an initial estimate of boundaries located within a field, said field having at least one existing wellbore, which method comprises:

placing an array of geophones at intervals in said existing wellbore, said geophone capable of detecting vibrations induced by said drilling;

first directionally drilling said wellbore generally towards a point on said estimated location of said boundary while obtaining data from said geophone array;

revising the estimated location of said boundary based, at least in part, upon said data;

second directionally drilling substantially towards a second point on said revised location of said boundary;

after said boundary is penetrated by said drilling, third directionally drilling within said target zone towards a third point on said boundary spaced apart from said second point; and fourth directionally drilling towards a fourth point on said boundary spaced apart from said second and third points.

2. The method of claim 1 which also comprises the step of fifth directionally drilling towards a fifth point on said boundary spaced apart from said second, third and fourth points.

3. The method of claim 2 which also comprises the step of fracturing said target zone after said second directionally drilling step.

4. The method of claim 3 which also comprises the step of fracturing said target zone after said third directionally drilling step.

5. The method of claim 4 which also comprises the steps of:

obtaining additional data from said geophone array during said fracturing step; and sixth directionally drilling towards a sixth point on said boundary, said direction based, at least in part, upon said additional data.

6. The method of claim 5 which also comprises the step of producing fluids from said zone after said fracturing step.

7. The method of claim 5 wherein said third, fourth and fifth directional drilling produces a substantially oscillatory path substantially within said target zone.

8. The method of claim 7 wherein said placing step locates at least one geophone within 3.2 kilometers of said target zone.

9. The method of claim 8 wherein said placing step includes at least one geophone located in said target zone.

10. The method of claim 9 wherein said placing step locates said geophones at interval distances ranging from about 3.048 to 30.48 meters.

11. The method of claim 10 wherein said third through sixth directional drilling steps create an oscillatory path which approaches said boundary no closer than 1.524 meters after said target zone is penetrated.

12. The method of claim 1 wherein said oscillatory path intercepts a horizontal plane within said target zone at three spaced-apart points.

13. The method of claim 12 wherein said oscillatory path defines an angle between each leg of the path and said angle ranges from about 60 to 120 degrees to the vertical.

14. The method of claim 13 wherein said directional path drilling steps are controlled by a digital controller.

15. A method of drilling an oscillatory wellbore path extending from an entry to an end point through a fluid producing zone comprising directionally drilling in a first direction within said fluid producing zone and directionally drilling in a second direction within said fluid producing zone, both of said directional drillings resulting in an oscillatory wellbore path, wherein at least 10 percent more fluid is produced when compared to a straighter wellbore path through said fluid producing zone extending from said entry to said end point.

16. The method of claim 15 wherein said straighter wellbore path is inclined at an angle at least 45 degrees to the vertically downward direction as measured from the vertical to the line connecting said entry and end points and wherein said oscillatory path does not lie substantially in a single vertical plane.

17. The method of claim 16 wherein said produced fluid increase is in the absence of fracturing said oscillatory path or said straighter path.

18. The method of claim 16 wherein said produced fluid increase is after fracturing said oscillatory and straighter paths.

19. A method for infill drilling a wellbore through an underground field to a target zone having an initially estimated location of a boundary within the underground field substantially between two existing wellbores, which method comprises:

placing an array of receivers within 3.2 kilometers of said target zone, said receivers capable of detecting vibrations induced by said drilling and producing data;

drilling towards said boundary while obtaining data from said receiver array; and revising the direction of said drilling based, at least in part, upon said data.

20. A method for drilling an underground wellbore from near a surface location to a target zone having a boundary at a location within an underground field, which method comprises:

placing an array of receivers within about 3.2 kilometers of said target zone, said receivers capable of detecting vibrations induced by drilling and producing data representative of said vibrations;

drilling towards said boundary while obtaining data from said array of receivers; and revising the direction of said drilling based, at least in part, upon said data.

21. The method of claim 20 wherein said data are produced by receivers located proximate to said wellbore near the surface of said field, wherein the vibrations are transmitted substantially through a drilling mud column is said wellbore.

22. The method of claim 21 wherein said data are supplemented by receivers located in at least one of said existing wellbores.

23. The method of claim 22 which also comprises the steps of:

obtaining additional data from said receiver array during said revised direction drilling;

revising the estimated location of said boundary based, at least in part, upon said additional data; and second revising the direction of said drilling substantially towards said revised location of said boundary.

24. An apparatus for drilling a wellbore to a target zone, said apparatus comprising:

(1) an array of geophones capable of producing signals related to drilling by means of (4) hereinafter;

(2) means for producing an estimate of the location of the boundary of said target zone;

(3) means for directionally drilling to a point on said estimated boundary;

(4) means for producing a revised estimate of the location of the boundary of said target zone based, at least in part, upon said signals;

(5) first means for controlling said directional drilling means to drill towards said revised estimate until said target zone is penetrated; and (6) second means for controlling said directional drilling means to drill an oscillatory path substantially within said target zone.

25. The apparatus of claim 24 which also comprises: means for fracturing said target zone; and an imager-controller.

26. The apparatus of claim 25 which also comprises means for producing an estimate of the fracture half length of any fractures produced by said fracture means based, at least in part, upon said signals.

27. An apparatus for drilling a wellbore into a target zone using a drilling mud, said apparatus comprising:

an array of geophones locatable in said wellbore and capable of detecting vibrations produced by said drilling and transmitted through said drilling mud, said geophones producing signals related to said drilling;

means for producing an estimate of the location of the boundary of said target zone based at least in part upon said signals;

means for directionally drilling to a point on said estimated boundary;

means for producing a revised estimate of the location of the boundary of said target zone based, at least in part, upon said signals;

first means for controlling said directional drilling means to drill towards said revised estimate until said target zone is penetrated; and second means for controlling said directional drilling means to drill an oscillatory path substantially within said target zone.

28. An apparatus which comprises:

(1) an array of drilling vibration sensors capable of being placed spaced apart locations at different depths underground;

(2) means for drilling capable of being movingly employed in a direction to produce a wellbore spaced apart from said array;

(3) means for obtaining drilling vibration data from said array when said means for drilling is movingly employed; and (4) means for changing the moving direction of said means for drilling based upon data obtained from step (3).

29. An apparatus which comprises:

(1) an array of drilling vibration sensors capable of being placed in a plurality of spaced apart locations;

(2) means for drilling in a direction to produce a cavity having at least a portion within about 3.2 kilometers of one of said spaced apart locations while obtaining data from said array; and (3) means for revising the direction of said drilling based upon data obtained from step (2).

30. The apparatus of claim 29 wherein said means for revising direction substantially aims toward a target zone until said target zone is penetrated.

31. The apparatus of claim 30 wherein said means for revising direction produces a substantially oscillatory drilling path within said target zone.

* * * * *

UNITED STATES PATENT AND TRADEMARK OFFICE

CERTIFICATE OF CORRECTION

PATENT NO. : 5,242,025

DATED : Sept. 7, 1993

INVENTOR(S) : Neill et al.

It is certified that error appears in the above-identified patent and that said Letters Patent is hereby corrected as shown below:

Claim 12, column 10, line 50, delete "1" and insert therefor -- 11 --.

Signed and Sealed this

Eighth Day of March, 1994

Bruce Lehman

*Attest:*

BRUCE LEHMAN

*Attesting Officer*

*Commissioner of Patents and Trademarks*